US006905445B1

(12) United States Patent
Lin

(10) Patent No.: US 6,905,445 B1
(45) Date of Patent: Jun. 14, 2005

(54) RESISTANCE ADJUSTER FOR ADJUSTING A RESISTANCE-PROVIDING MEMBER ON A STATIONARY BICYCLE

(75) Inventor: Pillar Lin, Taichung Hsien (TW)

(73) Assignee: Giant Manufacturing Co., Ltd., Taiwan (CN)

( * ) Notice: Subject to any disclaimer, the term of this patent is extended or adjusted under 35 U.S.C. 154(b) by 0 days.

(21) Appl. No.: 10/735,712

(22) Filed: Dec. 16, 2003

(51) Int. Cl.[7] ..... A63B 69/16

(52) U.S. Cl. ..... 482/57; 74/502.4; 74/502.6; 188/24.11

(58) Field of Search ..... 482/51, 57, 63–65; 74/502.2, 502.4, 502.6; 188/24.11–24.15, 24.19, 24.21, 344

(56) References Cited

U.S. PATENT DOCUMENTS 5,080,434 A * 1/1992 Locher ..... 297/300.8
5,232,207 A * 8/1993 Champ et al. ..... 267/70
5,383,819 A * 1/1995 Wang et al. ..... 474/144
5,685,806 A * 11/1997 Yu ..... 482/63
6,099,440 A * 8/2000 Schurter et al. ..... 482/63
6,152,266 A * 11/2000 Takizawa ..... 188/24.21
6,626,060 B2 * 9/2003 Matsuo ..... 74/502.6

* cited by examiner

*Primary Examiner*—Justine R. Yu
*Assistant Examiner*—Tam Nguyen
(74) *Attorney, Agent, or Firm*—Harness, Dickey & Pierce, P.L.C.

(57) ABSTRACT

A resistance adjuster for adjusting a resistance-providing member on a stationary bicycle includes a tubular housing, an elastic buffering member disposed in the housing and having upper and lower ends, an upper connecting member connected to the upper end of the buffering member, a lower connecting member connected to the lower end of the buffering member, a first string connected to the lower connecting member, a second string connected to the upper connecting member and the resistance-providing member, and an operating member connected to the first string and operable to displace the buffering member, the upper and lower connecting members, and the first and second strings in the axial direction.

7 Claims, 8 Drawing Sheets

RESISTANCE ADJUSTER FOR ADJUSTING A RESISTANCE-PROVIDING MEMBER ON A STATIONARY BICYCLE

BACKGROUND OF THE INVENTION

1. Field of the Invention

This invention relates to a resistance adjuster, more particularly to a resistance adjuster for adjusting a resistance-providing member on a stationary bicycle.

2. Description of the Related Art

FIG. 1 illustrates a conventional stationary bicycle that includes a flywheel 70, a resistance-providing member 71 that is in frictional contact with the flywheel 70 so as to provide resistance to the flywheel 70, and a resistance adjuster for adjusting the resistance-providing member 71. The resistance adjuster includes an operating member 72 mounted on a handlebar of the stationary bicycle, and a string 73 interconnecting the operating member 72 and the resistance-providing member 71. The conventional resistance adjuster is disadvantageous in that the resistance-providing member 71 tends to wear easily due to a rigid connection between the resistance-providing member 71 and the operating member 72 through the string 73.

SUMMARY OF THE INVENTION

Therefore, the object of the present invention is to provide a resistance adjuster with a buffering member that is capable of overcoming the aforesaid drawback of the prior art.

According to the present invention, there is provided a resistance adjuster for adjusting a resistance-providing member, which is in frictional contact with a flywheel of a stationary bicycle. The resistance adjuster includes: a tubular housing adapted to be mounted on the stationary bicycle and defining an axial direction; an elastic buffering member that is disposed in the housing, that has upper and lower ends opposite to each other in the axial direction, and that is elastically compressible in the axial direction; an upper connecting member connected securely to the upper end of the buffering member; a lower connecting member opposite to the upper connecting member in the axial direction and connected securely to the lower end of the buffering member; a first string that extends into the housing to connect securely with the lower connecting member; a second string that extends into the housing to connect securely with the upper connecting member and that is adapted to be connected securely to the resistance-providing member; and an operating member adapted to be mounted movably on the stationary bicycle, connected securely to the first string, and operable to displace the buffering member, the upper and lower connecting members, and the first and second strings in the axial direction so as to permit adjustment of the resistance-providing member.

BRIEF DESCRIPTION OF THE DRAWINGS

In drawings which illustrate embodiments of the invention.

DETAILED DESCRIPTION OF THE PREFERRED EMBODIMENTS

Figure 1:
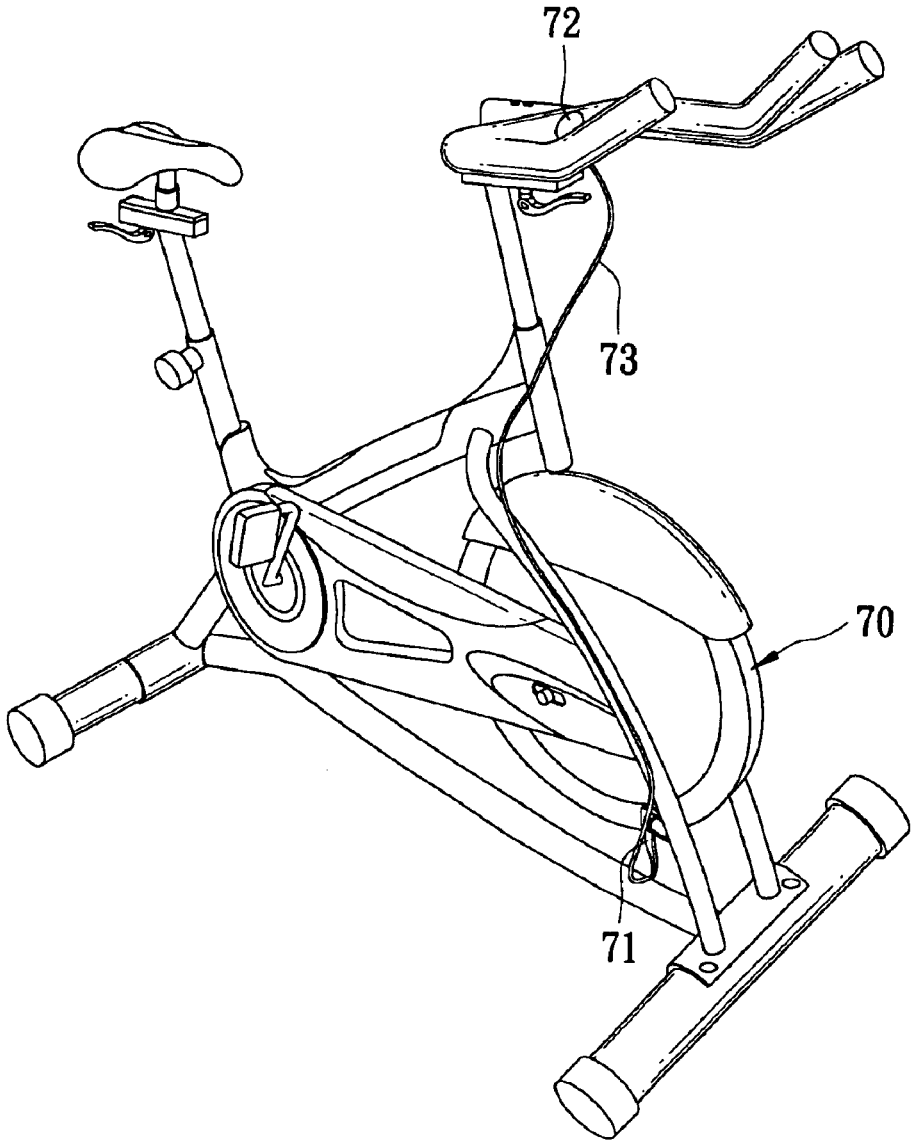
FIG. 1 PRIOR ART
FIG. 1 is a perspective view showing a conventional resistance adjuster for a resistance-providing member on a stationary bicycle.
Figure 2:
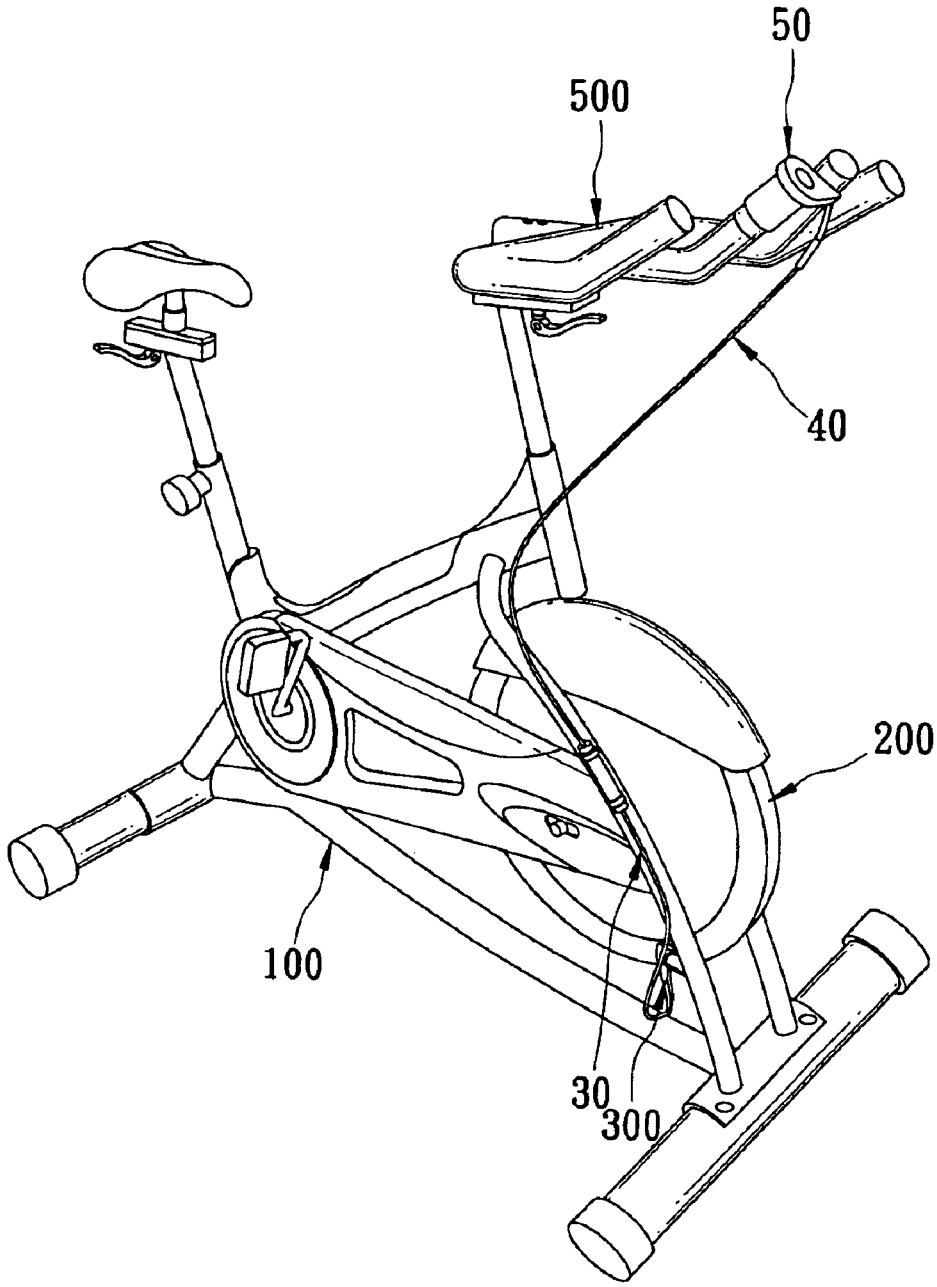
FIG. 2 is a perspective view showing the first preferred embodiment of a resistance adjuster for a resistance-providing member on a stationary bicycle according to the present invention.
Figure 3:
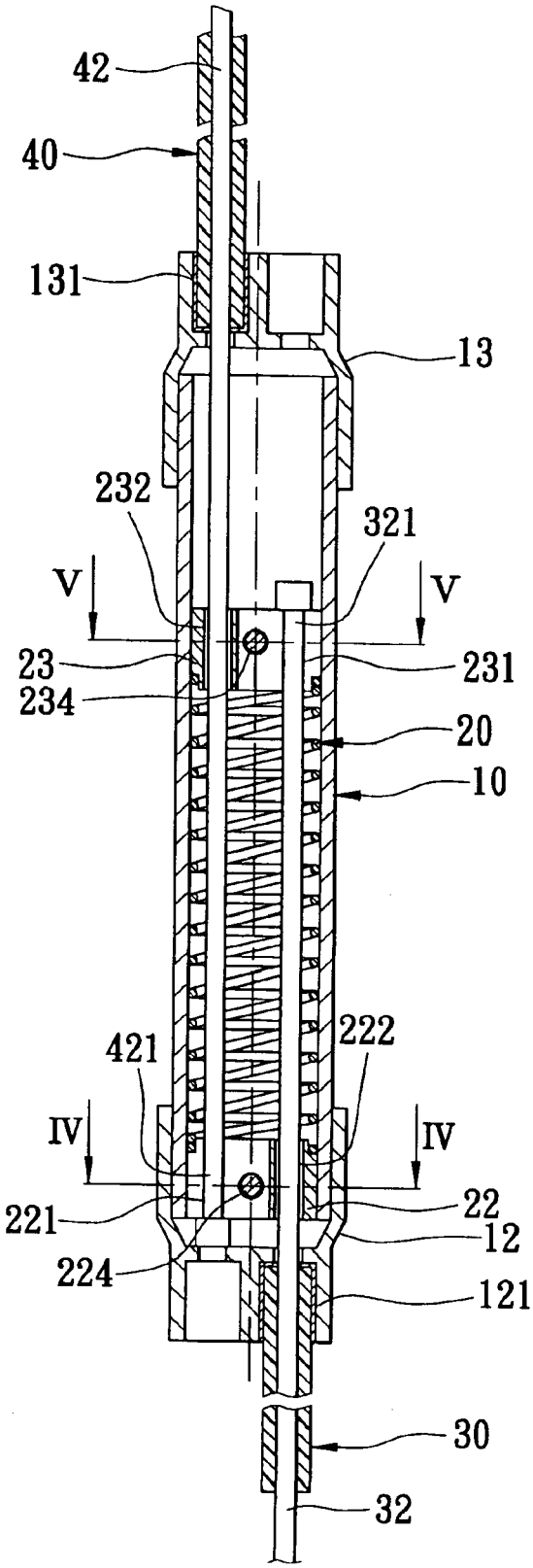
FIG. 3 is a fragmentary sectional view of the first embodiment.
Figure 4:
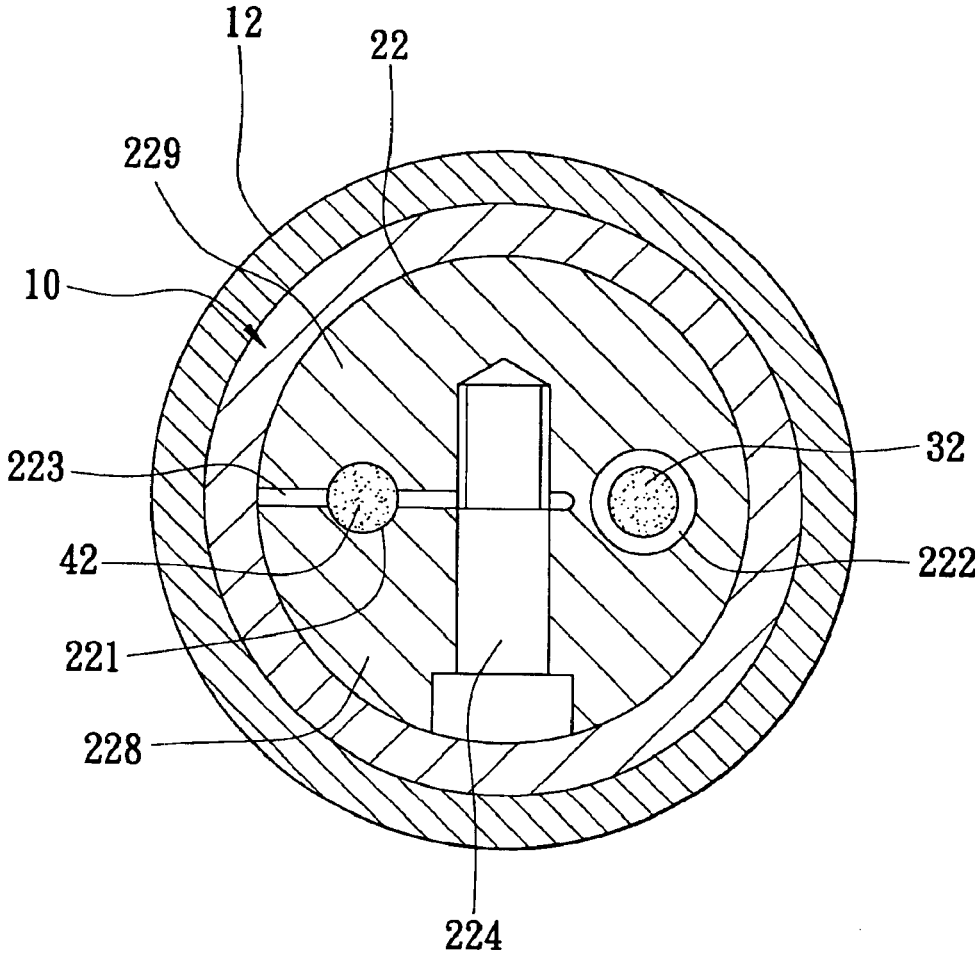
FIG. 4 is a sectional view taken along lines IV–VI in FIG. 3.
Figure 5:
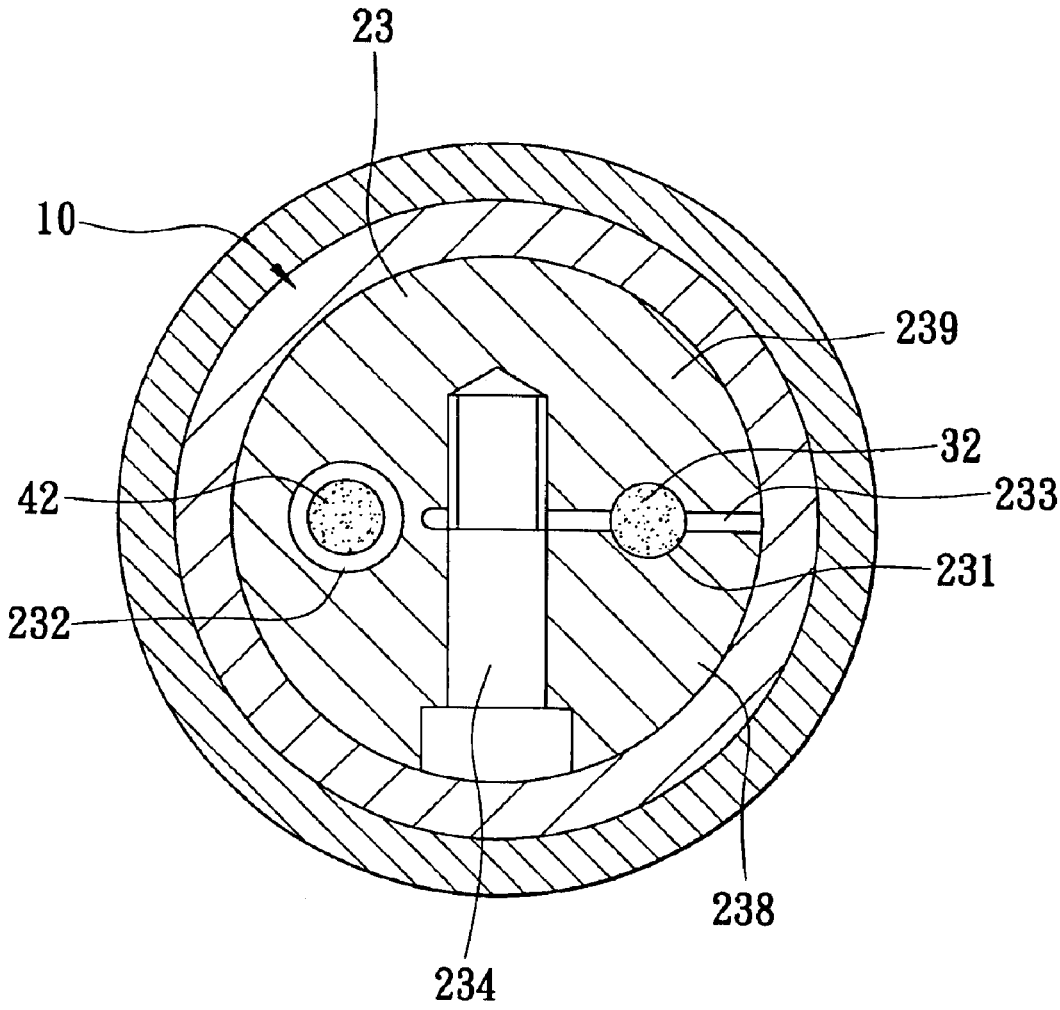
FIG. 5 is a sectional view taken along lines V—V in FIG. 3.

For the sake of brevity, like elements are denoted by the same reference numerals throughout the disclosure.

Figure 6:
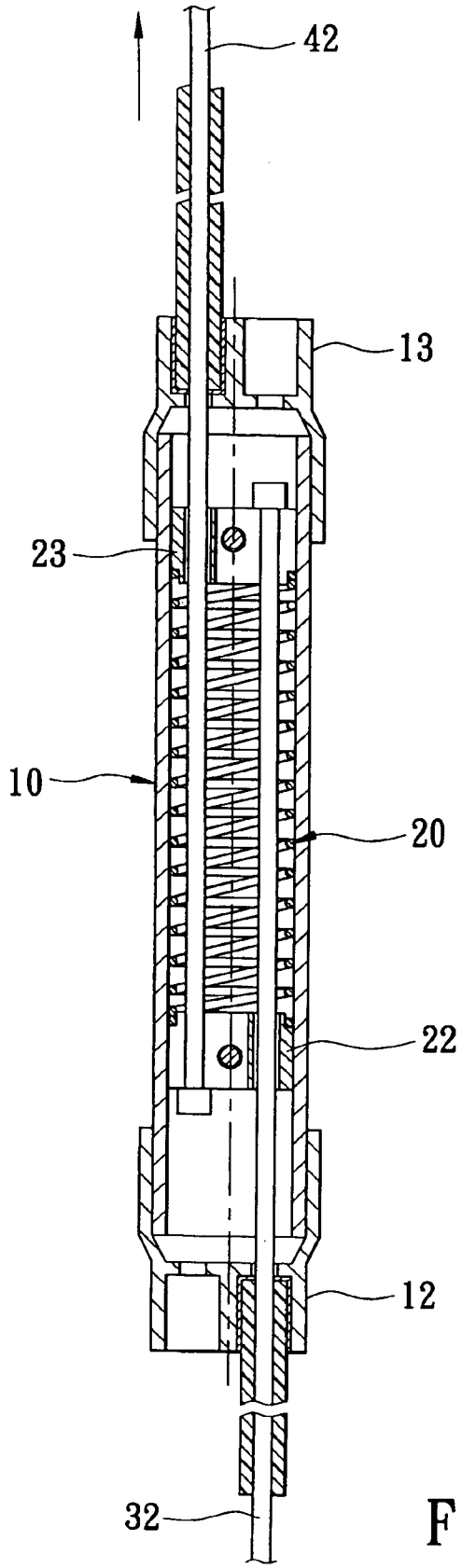
FIG. 6 is a fragmentary sectional view of the first embodiment, with a buffering member and two connecting members displaced in an axial direction.

FIGS. 2 to 5 illustrate the first preferred embodiment of a resistance adjuster for adjusting resistance provided by a resistance-providing member 300 to a flywheel 200 of a stationary bicycle 100 that is in frictional contact with the resistance-providing member 300 according to the present invention. The resistance adjuster includes: a tubular housing 10 mounted on the stationary bicycle 100 and defining an axial direction; an elastic buffering member 20 that is disposed in the housing 10, that has upper and lower ends opposite to each other in the axial direction, and that is elastically compressible in the axial direction; an upper connecting member 23 connected securely to the upper end of the buffering member 20; a lower connecting member 22 opposite to the upper connecting member 23 in the axial direction and connected securely to the lower end of the buffering member 20; a first string 42 that extends into the housing 10 to connect securely with the lower connecting member 22; a second string 32 that extends into the housing 10 to connect securely with the upper connecting member 23 and that is connected securely to the resistance-providing member 300; and an operating member 50 mounted movably on a handle bar 500 of the stationary bicycle 100, connected securely to the first string 42, and operable to displace the buffering member 20, the upper and lower connecting members 23, 22, and the first and second strings 42, 32 in the axial direction (see FIGS. 3 and 6) so as to permit adjustment of the resistance-providing member 300. Preferably, the buffering member 20 is in the form of a coil spring.

In this embodiment, each of the upper and lower connecting members 23, 22 is in the form of a cylindrical block that is in sliding contact with an inner wall of the housing 10 and that is formed with a clamping hole 231 (221) therein for extension of a respective one of the first and second strings 42, 32 therethrough, and a radial slit 233 (223) extending in a radial direction relative to the axial direction, intersecting the clamping hole 231 (221), and dividing the cylindrical block into first and second halves 238, 239 (228, 229). The clamping hole 231 (221) in each of the upper and lower connecting members 23, 22 has a cross-section, and extends in the axial direction. Each of the upper and lower connecting members 23, 22 includes a screw bolt 234 (224) that engages threadedly the cylindrical block, that extends through the first half 238 (228) of the cylindrical block and into the second half 239 (229) of the cylindrical block in a transverse direction relative to the slit 233 (223), and that intersects the slit 233 (223) so as to reduce the cross-section of the clamping hole 231 (221) and to thereby clamp the respective one of the first and second strings 42, 32 between the first and second halves 238, 239 (228, 229) of the cylindrical block upon tightening of the screw bolt 234 (224).

The cylindrical block of each of the upper and lower connecting members 23, 22 is further formed with a confining hole 232 (222) therein for extension of the other of the first and second strings 42, 32 therethrough. The confining hole 232 (222) and the clamping hole 231 (221) in each of the upper and lower connecting members 23, 22 are diametrically disposed.

Each of the first and second strings 42, 32 is enclosed by a protective sheath 40 (30). The first string 42 has an upper end that is connected securely to the operating member 50, and a lower end 421 that is opposite to the upper end and that is connected securely to the lower connecting member 22. The second string 32 has an upper end 231 that is connected securely to the upper connecting member 23, and a lower end that is opposite to the upper end of the second string 32 and that is connected securely to the resistance-providing member 300.

The resistance adjuster further includes upper and lower caps 13, 12 that are mounted respectively on upper and lower ends of the housing 10. Each of the upper and lower caps 13, 12 defines a confining recess 131 (121) that extends from the respective one of the upper and lower ends of the housing 10 in the axial direction. Each of the first and second strings 42, 32 extends through the confining recess 131 (121) in a respective one of the upper and lower caps 13, 12.

Figure 7:
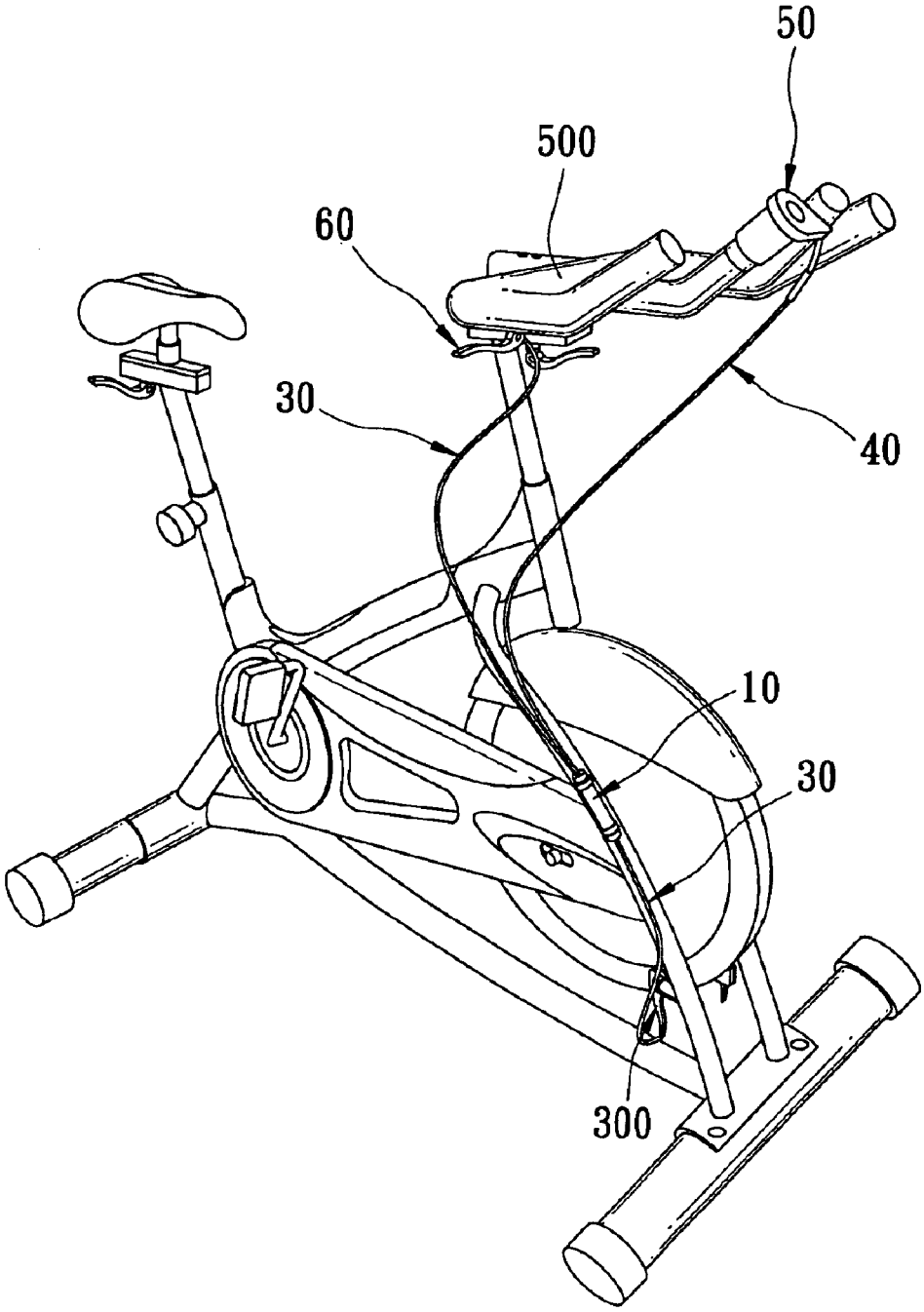
FIG. 7 is a perspective view showing the second preferred embodiment of the resistance adjuster according to the present invention.
Figure 8:
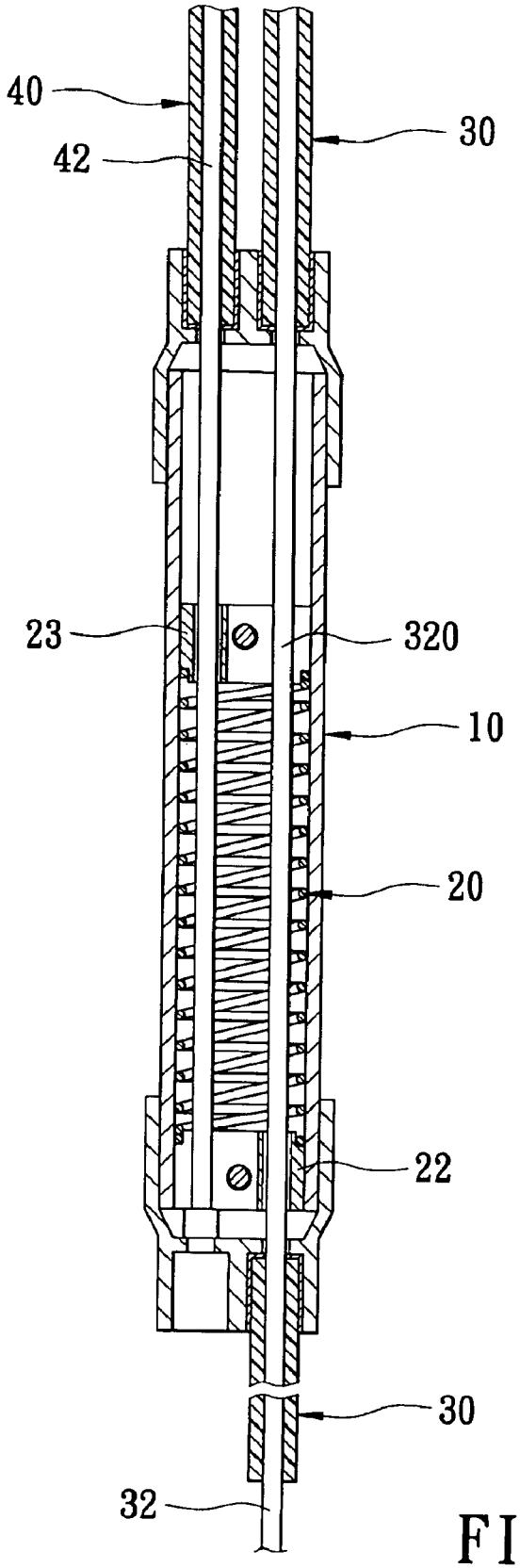
FIG. 8 is a fragmentary sectional view of the second embodiment.

FIGS. 7 and 8 illustrate the second preferred embodiment of the resistance adjuster according to the present invention. The resistance adjuster of this embodiment is similar to the previous embodiment, except that the second string 32 has an upper end connected securely to a brake operating member 60, which is mounted on the handlebar 500, and a middle segment 320 connected securely to the upper connecting member 23 and extending through the clamping hole 231 in the upper connecting member 23.

With the inclusion of the buffering member 20 in the resistance adjuster of this invention, the aforesaid wearing problem as encountered in the prior art can be eliminated.

With the invention thus explained, it is apparent that various modifications and variations can be made without departing from the spirit of the present invention.

I claim:

1. A resistance adjuster for adjusting a resistance-providing member, which is in frictional contact with a flywheel of a stationary bicycle, said resistance adjuster comprising:

a tubular housing adapted to be mounted on the stationary bicycle and defining an axial direction;

an elastic buffering member that is disposed in said housing, that has upper and lower ends opposite to each other in said axial direction, and that is elastically compressible in said axial direction;

an upper connecting member connected securely to said upper end of said buffering member;

a lower connecting member opposite to said upper connecting member in said axial direction and connected securely to said lower end of said buffering member;

a first string that extends into said housing to connect securely with said lower connecting member;

a second string that extends into said housing to connect securely with said upper connecting member and that is adapted to be connected securely to the resistance-providing member; and an operating member adapted to be mounted movably on the stationary bicycle, connected securely to said first string, and operable to displace said buffering member, said upper and lower connecting members, and said first and second strings in said axial direction so as to permit adjustment of the resistance-providing member.

2. The resistance adjuster of claim 1, wherein said buffering member is in the form of a coil spring, said housing having an inner wall, said upper and lower connecting members being in sliding contact with said inner wall of said housing.

3. The resistance adjuster of claim 1, wherein each of said upper and lower connecting members is in the form of a cylindrical block that is formed with a clamping hole therein for extension of a respective one of said first and second strings therethrough, and a radial slit extending in a radial direction relative to said axial direction, intersecting said clamping hole, and dividing said cylindrical block into first and second halves, said clamping hole having a cross-section and extending in said axial direction, each of said upper and lower connecting members including a screw bolt that engages threadedly said cylindrical block, that extends through said first half of said cylindrical block and into said second half of said cylindrical block in a transverse direction relative to said slit, and that intersects said slit so as to reduce said cross-section of said clamping hole and to thereby clamp the respective one of said first and second strings between said first and second halves of said cylindrical block upon tightening of said screw bolt.

4. The resistance adjuster of claim 3, wherein said cylindrical block of each of said upper and lower connecting members is further formed with a confining hole therein for extension of the other of said first and second strings therethrough.

5. The resistance adjuster of claim 1, wherein said first string has an upper end that is connected securely to said operating member, and a lower end that is opposite to said upper end and that is connected securely to said lower connecting member, said second string having an upper end that is connected securely to said upper connecting member, and a lower end that is opposite to said upper end of said second string and that is adapted to be connected securely to the resistance-providing member.

6. The resistance adjuster of claim 1, wherein said housing has upper and lower ends that are opposite to each other in said axial direction, said resistance adjuster further comprising upper and lower caps that are mounted respectively on said upper and lower ends of said housing, each of said upper and lower caps defining a confining recess that extends from the respective one of said upper and lower ends of said housing in said axial direction, each of said first and second strings extending through said confining recess in a respective one of said upper and lower caps.

7. The resistance adjuster of claim 1, wherein said first string has an upper end that is connected securely to said operating member, and a lower end that is opposite to said upper end and that is connected securely to said lower connecting member, said second string having an upper end that extends outwardly of said housing and that is adapted to be connected securely to a brake operating member, a lower end that is opposite to said upper end of said second string, that extends outwardly of said housing, and that is adapted to be connected securely to the resistance-providing member, and a middle segment that extends through and that is connected securely to said upper connecting member.

* * * * *